US005852985A

United States Patent [19]

Fisher

[11] Patent Number: 5,852,985

[45] Date of Patent: Dec. 29, 1998

[54] WATERCRAFT ANCHOR

[76] Inventor: John J. Fisher, 8363 Basswood Dr. Apt. 2A, Indianapolis, Ind. 46268

[21] Appl. No.: 890,349

[22] Filed: Jul. 9, 1997

Related U.S. Application Data

[60] Provisional application No. 60/021,512 Jul. 10, 1996.

[51] Int. Cl.[6] ..... B63B 21/27

[52] U.S. Cl. ..... 114/296; 114/300

[58] Field of Search ..... 114/294, 296, 114/300

[56] References Cited

U.S. PATENT DOCUMENTS

| | | | |
|---|---|---|---|
| D. 289,153 | 4/1987 | Silberman | D12/215 |
| 847,320 | 3/1907 | Crane . | |
| 1,271,442 | 7/1918 | Del Fungo-Giera . | |
| 1,319,419 | 10/1919 | Reynolds . | |
| 1,836,586 | 12/1931 | Gibb . | |
| 2,365,136 | 12/1944 | Behrens | 114/206 |
| 3,051,117 | 8/1962 | Hunter | 114/206 |
| 3,158,127 | 11/1964 | Gallaugher | 114/206 |
| 3,517,399 | 6/1970 | Horowitz | 9/8 |
| 3,520,269 | 7/1970 | Yett | 114/300 |
| 3,742,891 | 7/1973 | Diorio | 114/208 R |
| 3,760,760 | 9/1973 | Stevens | 114/206 R |
| 4,103,379 | 8/1978 | Wolfe | 9/8 R |
| 4,426,885 | 1/1984 | Visco | 73/432 R |
| 4,785,758 | 11/1988 | Eichelberger | 114/299 |
| 4,793,276 | 12/1988 | Stafford | 114/300 |
| 5,257,592 | 11/1993 | Schaefer | 114/215 |

FOREIGN PATENT DOCUMENTS

| | | | |
|---|---|---|---|
| 282352 | 9/1990 | Germany | 114/296 |

OTHER PUBLICATIONS

Anchor Bag Oct. 1996 Splash Down Anchors Advertised in Jet Sports Magazine.

Personal Watercraft Achor Kit 1996 Greenfield Products Inc. from product catalog.

Mushroom Anchor 1996 Greenfield Products INc. from product catalog.

*Primary Examiner*—Stephen Avila

[57] ABSTRACT

An anchor for personal watercraft provides a generally cylindrical housing closed at a top end and enclosing a concavity formed through the opposite, bottom, diametral end. The opening of the concavity is defined by a circumferential edge of the housing, and may be further shaped or formed with a circumferential edge or with a central and/or a plurality of circumferential spikes to readily engage with any of a variety of materials found on the floor of a water body or beach. A weight may be removably attached to either the top side or within the concavity at the bottom side of the anchor, thereby functioning as additional ballast as may be necessary to overcome natural buoyancy of any air trapped in the concavity when the anchor is lowered into an anchoring position, or to overcome heavier seas.

13 Claims, 5 Drawing Sheets

WATERCRAFT ANCHOR

This application claims the benefit of U.S Provisional Application No. 60/021,512 filed Jul. 10,1996.

FIELD OF THE INVENTION

This invention is directed generally to watercraft anchors, and more particularly to watercraft anchors for use with personal watercraft, having a small, relatively lightweight structure with good gripping performance characteristics.

BACKGROUND OF THE INVENTION

Watercraft anchors are well known and widely used for anchoring ships, boats and marker buoys, and for otherwise securing a vessel while in a body of water. Such bodies of water may include lakes, rivers and oceans in which the watercraft is to be anchored. Each of these so mentioned bodies of water oftentimes include a floor having a composition which may vary widely from that of silt or mud, to that of a rocky or gravelly composition, thereby providing a broad spectrum of challenging surfaces in which the anchor is to be secured.

Although relatively small watercraft have been widely used for centuries, anchors for securing such watercraft have been generally unwieldy, with one or more extending protrusions which together form a cumbersome and hazardous apparatus that is difficult to store in a compact area, and whether in use or when being deployed or retrieved, are known to scrape or abrade the vessel hull and deck and to project hazardous surfaces, edges and projections to the unwary in the deployed condition.

Thus, in spite of evolutionary design changes for anchors for watercraft, such prior art anchors include important disadvantages, especially if used in the environment of small watercraft including motorized watercraft such as Jet Ski™ type self-propelled pleasure watercraft. Anchors for small watercraft include U.S. Pat. Nos. 5,257,592; 4,793,276; 4,785,758; 4,426,885; 4,103,379; 3,760,760; 3,742,891; 3,517,399; 3,158,127; 3,051,117; 2,365,136; 1,836,586; 1,319,419; 1,271,442; 847,320 and Design U.S. Pat. No. 289,153. The watercraft anchors described in the above-listed U.S. Patents include bottom-facing concavities, top-facing concavities, anchors with generally convex shapes, and anchors having extending appendages. As to the those anchors having bottom-facing concavities, generally each such patent incorporates a top surface vent manipulated remotely by complex mechanisms for releasing any air contained in the concavity. See for example, U.S. Pat. Nos. 3,760,760 and 3,051,117.

Other prior art anchors include anchor bags typically filled with sand or rocks which generally does not provide a compact predetermined shape which can be readily received and secured in a shaped recess as may be molded or formed in a deck portion of a personal watercraft. Another prior art anchor is a type known as a mushroom anchor which provides a generally higher profile, and due to its generally rounded exterior, is suitable for use in softer, more homogenous soils and muds, although with less grabbing power in harder materials such as gravel or rock.

Accordingly, there is a need for a watercraft anchor which is particularly suitable for smaller personal watercraft, which is easily transportable yet provides a suitable ballast, yet provides enhanced gripping and holding power with increased resistance to movement due to variations in soil affinity and a suction effect. It is further desired to provide such personal watercraft anchor which has a relatively low profile with a substantially streamlined upper surface which provides few or no top surface obstructions or hazards in the installed condition, to swimmers or boat hulls in the immediate vicinity.

SUMMARY OF THE INVENTION

The personal watercraft anchor of the present invention overcomes these and other disadvantages of the related art by providing a generally cylindrical housing closed at one end and enclosing a concavity formed through the opposite diametral end. The opening of the concavity is defined by a circumferential edge of the housing, and may be further shaped or formed to readily engage with or bite into any of a variety of materials found on the floor of a water body, including sand, soil, silt, gravel, rocks or other material typically found on the floor or beaches of natural or man-made water bodies. According to one embodiment of the present invention, the anchor has a width to height ratio in the range of about 2:1 to 4:1, with a rope attachment at the top surface thereof which may be recessed or slightly extending from the top surface. According to another embodiment of the invention, a ballast may be removably attached to either the top side or within the concavity at the bottom side of the anchor, thereby functioning as additional ballast as may be calculated to overcome natural buoyancy of any air trapped in the concavity when the anchor is lowered into an anchoring position, or to overcome heavier seas. According to yet another embodiment of the invention, a central spike or one or more circumferential spikes extend in a downwardly direction to engage with the floor of the water body or with a beach surface.

The personal watercraft anchor of the present invention may have one of a variety of finishes, including a powder coated finish, plastic or rubber coating, or colored plastic so as to encase the metal or other materials having a substantially and suitable sturdy anchor construction while providing an additional element of protection to both the anchor and the personal watercraft with which it is used. Alternatively, the anchor of the present invention may have a molded construction of ABS plastic or other high impact, durable polymeric construction, incasing a centrally located metal ballast. Also, the anchor of the present invention may be fabricated of galvanized or stainless steel material so as to protect it from the corrosive effects of sea or saltwater.

Additional weight plates, if any, may be likewise coated or constructed in the manner contemplated in the fabrication of the anchor.

An anchor line is affixed to the anchor with a plastic or metal hook and a float at the opposite end to mark anchor location and water depth for providing a reference point when the watercraft is idle.

Figure 7:
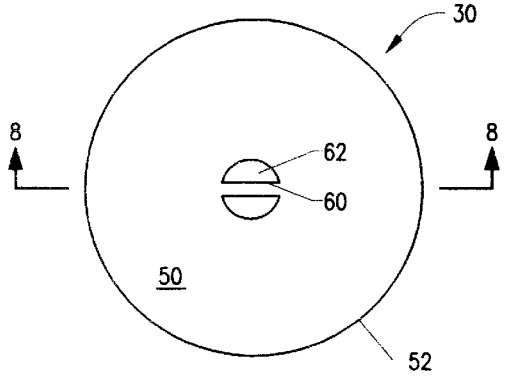
Figure 8:
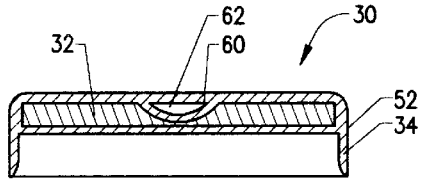
Figure 9:
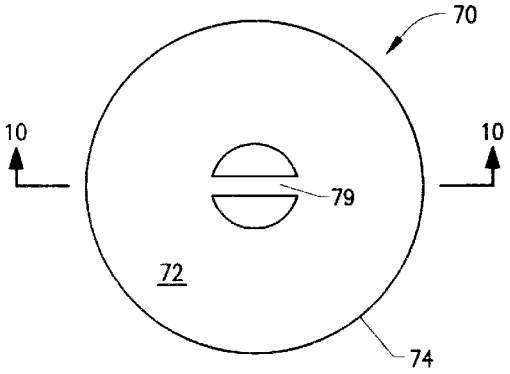
Figure 10:
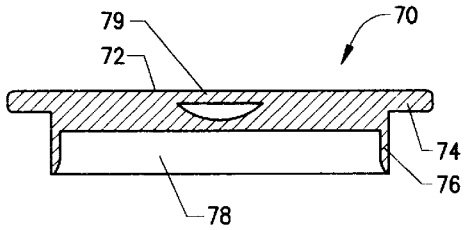
Figure 11:
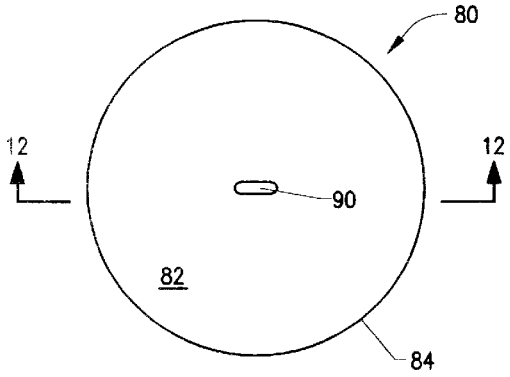
Figure 12:
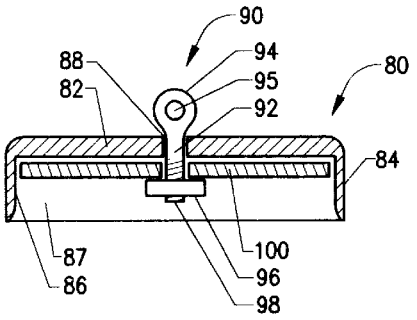
Figure 13:
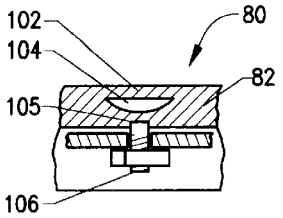
Figure 14:
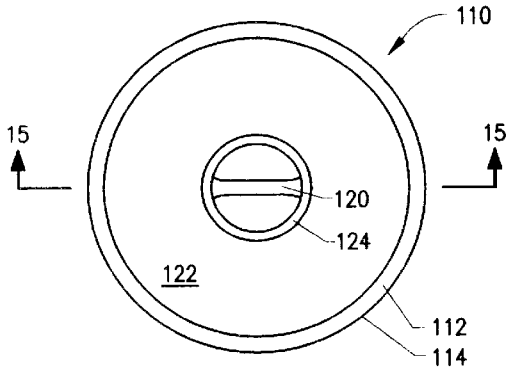
Figure 15:
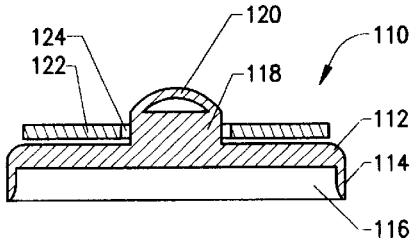
Figure 16:
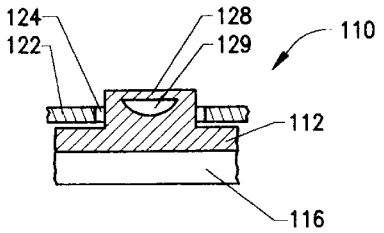
Figure 17:
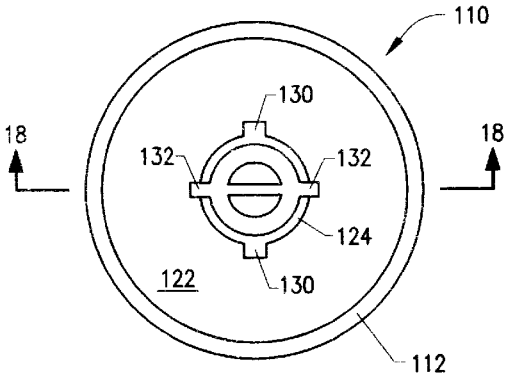
Figure 18:
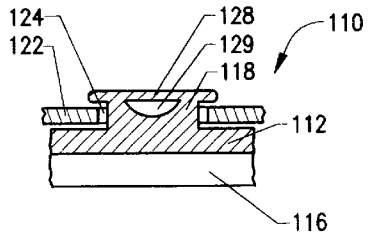
Figure 19:
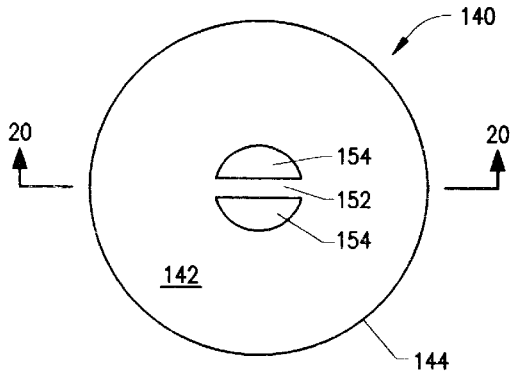
Figure 20:
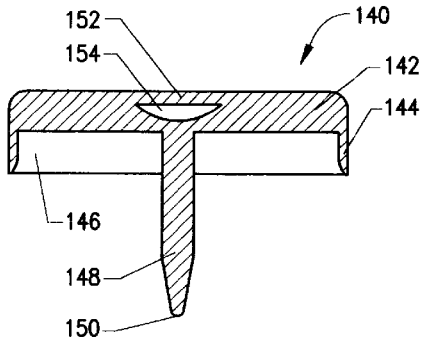
Figure 21:
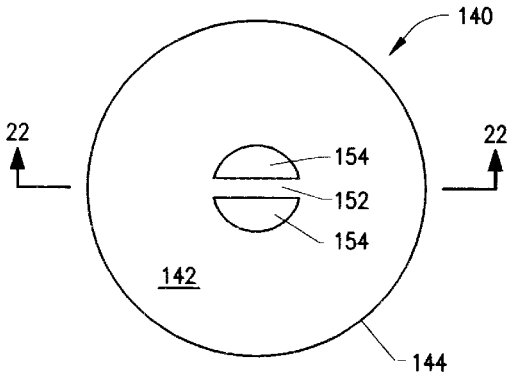
Figure 22:
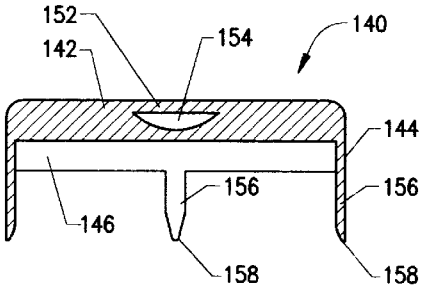
Figure 23:
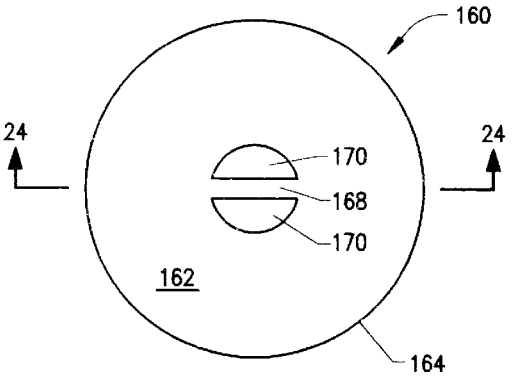
Figure 24:
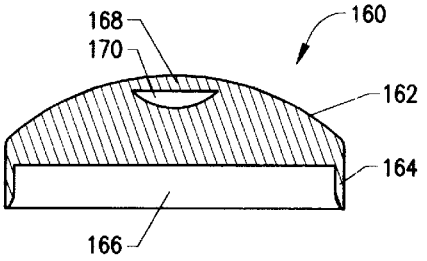

FIG. 7 is a top plan view of another embodiment of the present invention;

FIG. 8 is a vertical sectional view taken along plane 8—8 of FIG. 7, showing an embodiment of the anchor having a substantially polymeric construction with an encased metal ballast;

FIG. 9 is a top plan view of another embodiment of the anchor of the present invention;

FIG. 10 is a vertical sectional view taken along plane 10—10 of FIG. 9;

FIG. 11 is a top plan view of another embodiment of the watercraft anchor of the present invention;

FIG. 12 is a vertical sectional view taken along plane 12—12 of FIG. 11, showing an arrangement for attaching an additional weight to the anchor of the present invention;

FIG. 13 is a fragmentary vertical sectional view showing an alternative arrangement of the weight mounting arrangement of FIG. 12;

FIG. 14 is a top plan view of another embodiment of the watercraft anchor of the present invention;

FIG. 15 is a vertical sectional view taken along plane 15—15 of the FIG. 14, showing an alternative embodiment for mounting weight plates to the watercraft anchor;

FIG. 16 is a fragmentary vertical sectional view showing an alternative arrangement of the weight and rope mounting attachment of FIG. 15;

FIG. 17 is a top plan view of another embodiment of the watercraft anchor of the present invention;

FIG. 18 is a vertical sectional view taken along plane 18—18 of FIG. 17, showing an alternative securement arrangement for the weight plates to be mounted to the top surface of the watercraft anchor;

FIG. 19 is a top plan view of another embodiment of the watercraft anchor of the present invention;

FIG. 20 is a vertical sectional view taken along plane 20—20 of FIG. 19, showing a central spike for providing additional holding resistance to the anchor in an in situ installation of the anchor;

FIG. 21 is a top plan view of another embodiment of the watercraft anchor of the present invention;

FIG. 22 is a vertical sectional view taken along plane 22—22 of FIG. 21, showing a plurality of circumferentially distributed spikes for engaging with the floor of a water body in which the anchor is to be installed;

FIG. 23 is a top plan view of another embodiment of the watercraft anchor of the present invention; and FIG. 24 is a vertical sectional view taken along plane 24—24 of FIG. 23, showing a convex upper surface of the watercraft anchor of the present invention.

DETAILED DESCRIPTION OF THE PREFERRED EMBODIMENTS

Referring now in detail to the drawings wherein like parts are designated by like reference numerals throughout, there is illustrated in FIGS. 1–8 a first embodiment of the watercraft anchor of the present invention which is designated generally by reference numeral 30. The anchor 30 includes a generally cylindrical housing formed from readily available metal pipe stock or molded with metal or plastic having a top generally cylindrical end 32, transitioning to a cylindrical wall 34 having an interior circumferential surface 36. The interior circumferential wall 36 transitions to an underside 38 of the top cylindrical plate or surface 32, and defines a concavity 40 opening downwardly through the opposite diametral end defined by the cylindrical wall 34.

According to this preferred embodiment of the present invention, the anchor 30 has an outside diameter measuring in the range of 7 to 10 inches in diameter, with a height measuring in the range of 1.5 to 4 inches although it will be appreciated that this invention is contemplated for use with smaller vessels requiring a smaller anchor or, with larger vessels requiring a larger anchor, and that the diameters and heights will be adjusted accordingly. An initial version of this first embodiment of the present invention included a lateral dimension, i.e. diameter, of 7.5 inches, with a height of 1.75 inches, weighing 8.5 pounds. It has been discovered, however, that better results occur when the housing diameter is at least twice and ideally three to four times the anchor height. Thus, it is contemplated that smaller or larger anchors will be constructed in view of this diameter to height ratio, which itself may be varied. By way of non-limiting example only, the diameter to height ratio may be varied to overcome a greater buoyancy effect in a larger scale version of this anchor, or to overcome a greater buoyancy effect in brackish waters. Alternatively, this ratio may be reduced for smaller vessels or for use with water bodies having a particularly heavily graveled floor. In the latter case, a relatively smaller diameter enables a user to urge his foot against the top of the anchor top firmly plant the anchor to a sufficient depth, although this method of setting the anchor may be applied to any of the embodiments of the present invention. As described above, the watercraft anchor 30 is formed from readily available pipe stock which may be fabricated of stainless steel or galvanized steel having good noncorrosion characteristics. An anchor line attachment 44 is secured with a welded connection or bolted connection to the center of the top surface of the cylindrical end 32, thereby providing a recess 45 for receiving and attaching the anchor line.

Figure 3:
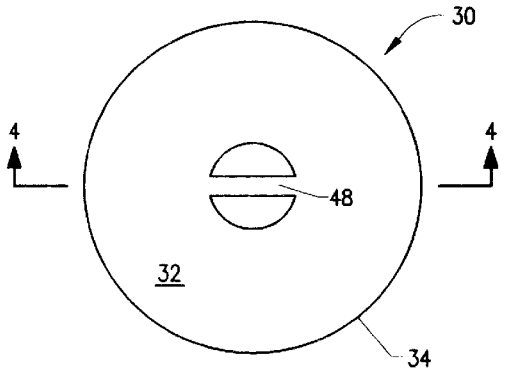
FIG. 3 is a top plan view of another embodiment of the watercraft anchor of the present invention.
Figure 4:
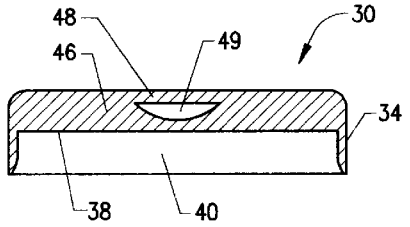
FIG. 4 is a vertical sectional view taken along plane 4—4 of FIG. 3, showing a recessed rope attachment point.

With reference now to FIGS. 3 and 4, an anchor line attachment 48 is secured to the top surface of the cylindrical end 32 in a flush arrangement therewith, and providing a recess 49 for receiving an anchor line. According to this embodiment, the top surface of the cylindrical end 32 is thus provided with a flat, virtually projectionless top surface which is safe for swimmers and users especially in shallow water, and which provides a greatly reduced obstruction to the hulls of boats anchored nearby. In the instance where the anchor is set in beach sand, it will be apparent that this flat profile is less likely to pose an objectional obstruction to unwary pedestrians and vehicles.

Figure 1:
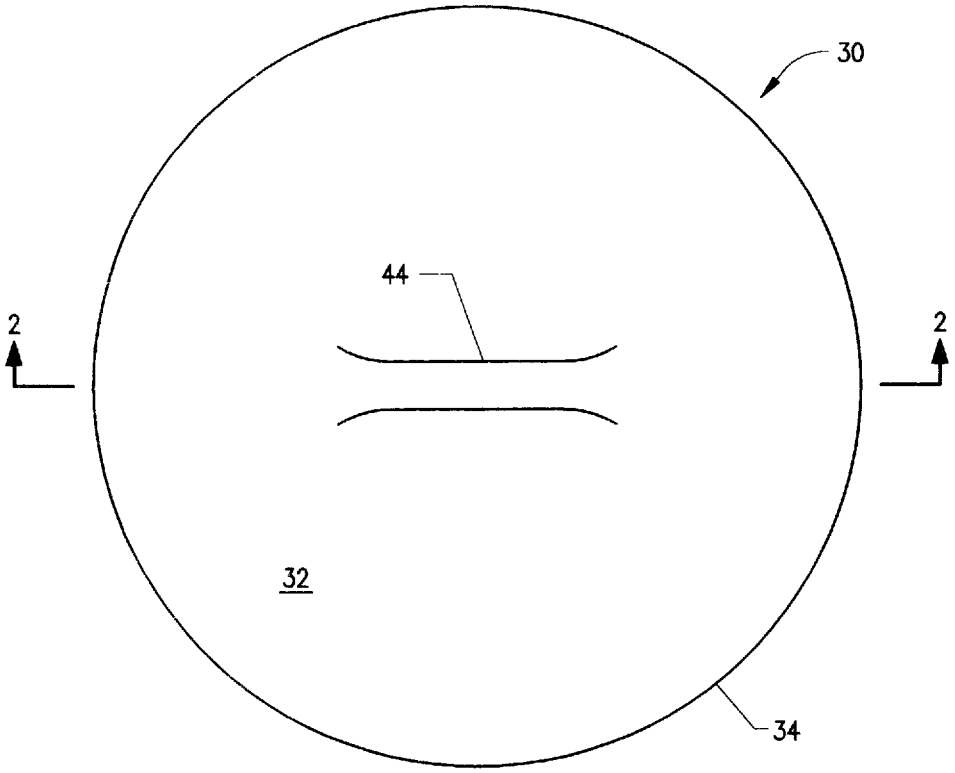
FIG. 1 is a top plan view of one embodiment of the watercraft anchor of the present invention.
Figure 2:
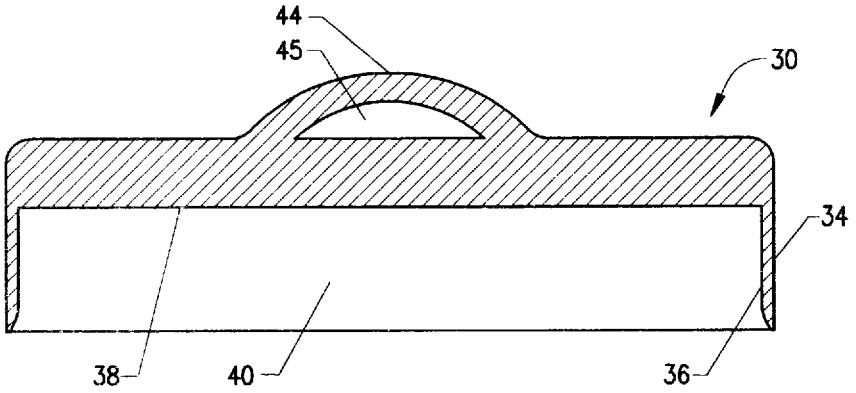
FIG. 2 is a vertical sectional view taken along plane 2—2 of FIG. 1, showing an upwardly extending rope attachment point.
Figure 5:
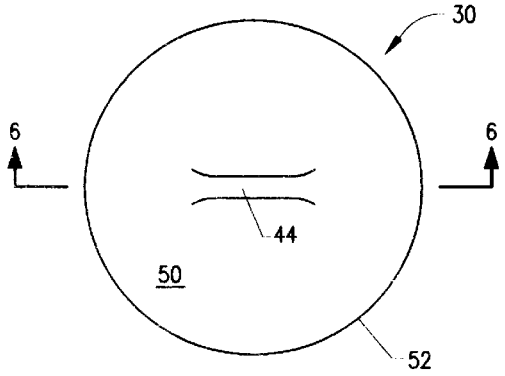
FIG. 5 is a top plan view of another embodiment of the present invention.
Figure 6:
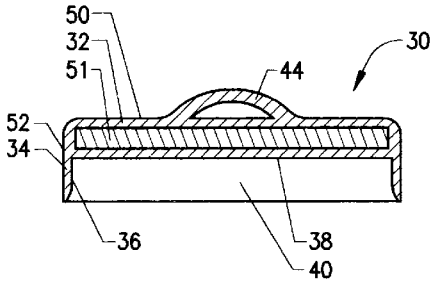
FIG. 6 is a vertical sectional view taken along plane 6—6 of FIG. 5, showing the watercraft anchor of FIGS. 1 and 2 having a substantially polymeric construction with a central, encased metal ballast.

FIGS. 5 and 6 are based on the embodiment of the watercraft anchor shown in FIGS. 1 and 2. More particularly, the cylindrical end 32 is fabricated of a substantially polymeric construction encasing a metal ballest 51, and having an outer surface 50, and the cylindrical wall 34 is encapsulated in or formed with the same or a compatible material 52. This encapsulating material is further extended to completely cover the interiors circumferential surface 36 and extending over the entirety of the underside 38 of the anchor, thereby fully encapsulating and protecting the base material of the anchor 30. Although ABS or plastic.sheathing is discussed herein, it will be apparent to those skilled in the art to which this invention pertains may consider other surface coatings or sandwiches of coatings, including but not limited to paints, galvanized finishes, alternative powder coatings, alternative plastic coatings, rubber coating, or other plastic materials. It will be further apparent to the skilled artisan that such materials may be integrally or surface colored and decorated with designs, characters, numbers, or other markings as desired to match the color of the watercraft with which the anchor is to be used, or to identify the anchor as may be desired.

FIGS. 7 and 8 show the watercraft anchor of the embodiment shown in FIGS. 3 and 4 encapsulated in the manner described for the embodiment shown in FIGS. 5 and 6. It will be noted that the recessed anchor line attachment includes a sheathing 60 which maintains a recess 62 for receiving an anchor line to be projected therethrough.

Now referring to FIGS. 9 and 10, another embodiment of the present invention includes a watercraft anchor 70 having a cylindrical end 72 and a flange 74 extending radially outwardly therefrom beyond the diameter of a cylindrical wall 76, which defines a concavity 78 sized and shaped in the manner previously described. As with the embodiment described in FIGS. 3, 4, 7 and 8, anchor 70 includes a recessed anchor line attachment 79 for maintaining a flush top surface of the anchor. In particular, the flange 74 provides added leverage for planting the anchor 70 especially by foot in the floor of the body of water or beach in which the anchor 70 is to be installed.

Referring to FIGS. 11–13, a watercraft anchor 80 includes a cylindrical end 82 transitioning to a cylindrical wall 84 in the manner previously described. The cylindrical wall 84 includes an inner circumferential surface 86, which transitions to an underside of the cylindrical end 82 in the manner previously described, thereby defining a concavity 87 opening downwardly through the opposite diametral end defined by the cylindrical wall 84. A recess 88 is formed at the center of the cylindrical end 82. A bolt 90 includes a threaded shaft 92 extending from a bolt head 94 having an eyelet 95 for receiving an anchor line in the manner previously described. In the installed condition, the bolt 90 is projected from the cylindrical end 82 such that the shaft projects through the recess 88 into the concavity 87. In this position, a ballast plate 100 having a concentric recess is received by the shaft 92, and is restrained in place by a fastener 96 threaded onto a shaft end 98. As will be apparent to those skilled in the art to which this invention pertains, the ballast plate 100 may be varied in shape, including diameter, and thickness, as well as material of construction to provide the necessary and desired ballast for existing water conditions. It is further contemplated by the present invention, that the ballast plate 100 may be one of a set of ballast plates having selected weights incrementally sized to meet various water conditions. It is further contemplated that the plates may be encased, coated or encapsulated in the manner previously described for the anchor. Accordingly, a personal watercraft user may vary the overall weight of the anchor to meet existing water conditions. Referring now to FIG. 13, an anchor line attachment 102 is formed in a planar configuration at the top surface of the cylindrical end 82 to provide a smooth, obstruction free top surface, while retaining a recess 104 for receiving an anchor line. According to this embodiment, a blind hole 105 is formed in the underside of the cylindrical end 82 to receive a bolt stud 106 for securing a ballast plate 100 to the interior of the anchor 80.

With reference now to FIGS. 14–18, an upstanding boss 118 projects upwardly from the center of a cylindrical end 112. The cylindrical end 112 transitions to a circumferential wall 114 which defines a downwardly opening concavity 116 in the manner previously described. Unlike the embodiment disclosed in FIGS. 11–12, however, that concavity 116 is free of the obstructions provided in the underside of anchor 80. Specifically, the boss 118 includes an arcuate anchor line attachment 120, and is sized and shaped to receive a ballast plate 122 at a central recess 124 thereof. In the installed condition, the ballast plate 122 is held in substantially planar contact with the top surface of the cylindrical end 112 by its own weight. With reference to FIG. 16, an anchor line attachment 128 has a substantially flat upper surface with a recess 129 formed therethrough for receiving an anchor line. According to both embodiments, the ballast plate 122 is sized and shaped to nest over the boss 118, and one or more ballast plates 122 are contemplated to be used simultaneously. Alternatively, the anchor 110 may be used without benefit of the ballast plate 122 as conditions may warrant.

With reference to FIGS. 17 and 18, a pair of radially outwardly extending tabs 132 extend from the top surface of the boss 118. According to this embodiment, the recess 124 formed in the ballast plate 122 includes one or more keyways 130 through which the tabs 132 are received, the ballast plate 122 then being rotated to lock the ballast plate 122 to the anchor 110. As will be apparent to one skilled in the art to which this invention pertains, the tabs 132 and the keyway 130 may be varied to further limit relative rotation therebetween. It is further contemplated that a stop (not shown) may be formed in at least one location of the keyway to prevent excessive rotation of the ballast plate 122 in the installed condition.

Another embodiment of the anchor of the present invention is shown in FIGS. 19–22. An anchor 140 having a cylindrical end 142, transitions to a circumferential wall 144 to define a concavity 146 in the manner common to all of the above-described embodiments of the present invention. A central spike 148 extends from the under surface of the cylindrical end 142 and projects downwardly through the concavity 146 and terminates at a sharp or blunt tip 150 (which may be spiraled, serated or otherwise formed to enhance gripping) for engaging with a floor of a water body or beach, followed by engagement of the cylindrical wall 144 with the water body floor or beach. As with, for example, the embodiment of the present invention shown in FIGS. 3–4, an anchor line attachment 152 is formed flush with the top surface of the cylindrical end 142, with a recess 154 formed thereunder for receiving an anchor line. According to another embodiment, the anchor 140 includes a plurality of downwardly extending spikes 156 extending from the cylindrical wall 144. The spikes 156 each have a point or other shaped end 158 to engage with the floor of the water body as is desired. The circumferentially arrayed spikes 156 may be spaced one from the next at even or uneven increments. It is further contemplated that the circumferential spikes 156 may be combined with the central spike 148 shown in FIG. 20.

With reference now to FIGS. 23 and 24, there is shown a alternative anchor 160 having a dome shaped top structure 162 extending in arcuate fashion to a circumferential wall 164 for defining a downwardly opening concavity 166. A flush mounted anchor line attachment 168 includes a recess 170 for receiving an anchor line. It is contemplated that the dome shape of this embodiment of the anchor 160 may be altered to include, by way of example only, an oval or truncated overall shape which may include an enlarged concavity 166 to meet particular water body requirements.

Anchor lines, including clips and floats (all not shown) of conventional design are used to affix the anchor to a water vessel. Preferably, plastic hooks having relatively lightweight may include a break away feature to prevent dangerous conditions when the water vessel is accidentally driven off before being detached from the anchor or before the anchor is retrieved prior to cast off.

Although certain presently preferred embodiments of the invention have been described herein, it will be apparent to those skilled in the art to which the invention pertains, that variations and modifications of the described embodiments may be made without departing from the spirit and scope of the invention.

I claim:

1. An anchor for mooring watercraft and other floating objects, comprising:

a generally cylindrical housing having a predetermined diameter to height ratio and including, a top generally cylindrical end, having a top surface and an underside, a cylindrical wall, having a predetermined thickness, an exterior circumferential surface, and an interior circumferential surface, said cylindrical wall transitioning from said top cylindrical end, and said interior surface transitioning from said underside of said top cylindrical end, a concavity, defined by said interior circumferential surface and said underside of said top cylindrical end, and opening downwardly through the diametrically opposite end of said cylindrical wall, a connecting means fixedly attached to the center of said top surface of said top cylindrical end for the attachment of a rope or cable thereto, wherein said cylindrical housing is manufactured of material including plastics, concrete, lead, stainless steel, galvanized metal and other metals, whereby said anchor is easily installed as the cylindrical wall readily engages in the soil at the bottom of a body of water with the urging of a users foot and the holding efficiency of said anchor is maximized by the utilization of the combination of the anchors weight, a suction effect caused by the concavity, and the affinity between the soil and the surfaces of the cylindrical wall, and whereby the maximized holding efficiency allows for a smaller and lighter anchor that is easy to use and transport with smaller watercraft such as a personal watercraft.

2. The anchor of claim 1 wherein said top surface of said top cylindrical end is substantially planar.

3. The anchor of claim 1 wherein said top surface of said top cylindrical end is substantially convex.

4. The anchor of claim 1 wherein said connecting means is fixedly attached in a recess in the center of said top surface of said top cylindrical end.

5. The anchor of claim 1 wherein said anchor is completely covered with a surface coating or encasement including paints, plastics, rubber, vinyl, powder coatings and galvanized finishes.

6. The anchor of claim 1 wherein said top cylindrical end is manufactured of formed or molded plastics encasing a metal ballast.

7. The anchor of claim 1 further including a flange extending radially outward therefrom beyond the diameter of said cylindrical wall and having a top surface that is flush with said top surface of said top cylindrical end.

8. The anchor of claim 1 further including a spike or shaped projection extending downwardly from the center of said underside of said top cylindrical end.

9. The anchor of claim 1 further including a plurality of spikes extending downwardly from said cylindrical wall.

10. The anchor of claim 1 further including an attachment means for removably attaching a weight or ballast plates thereby providing additional ballast for said anchor.

11. The anchor of claim 1 wherein an urging means is used against said top surface of said cylindrical end for installing said anchor.

12. An improved anchor for securing watercraft and other floating objects to a beach or a bottom of a body of water, comprising:

a generally cylindrical housing, closed at a top end with a cylindrical plate, and enclosing a concavity through the opposite, bottom end, said concavity defined by a cylindrical wall, with a circumferential edge of said cylindrical wall defining the opening of said concavity, an anchorline connecting means fixedly attached to the center of the top surface of said cylindrical plate for the attachment of an anchorline from a watercraft or floating object, wherein a spike or shaped projection extends downwardly from the center of the underside of said cylindrical plate, wherein said cylindrical housing has a predetermined diameter to height ratio, wherein said cylindrical wall and circumferential edge have a predetermined thickness, wherein said cylindrical housing is manufactured of material including plastics, concrete, stainless steel, galvanized metal, lead and other metals, whereby the combination of the generally cylindrical housing providing a more rounded and streamlined top surface and a diameter to height ratio providing a low profile thereby reduces the potential for injury to persons and damage to watercraft that may be in the vicinity of said anchor when installed in shallow water, as is commonly done in the environment of personal watercraft, and whereby the predetermined thickness of the cylindrical wall and the circumferential edge eases and increases the anchors engagement with the soil at bottom of the body of water during installation and when installed, a natural affinity between the soil and the surfaces of the cylindrical wall, in addition with a suction effect of the concavity, thereby increase the resistance of the anchor to be moved or dislodged, more so than would occur with only the weight of the anchor alone.

13. An improved anchor for securing watercraft and other floating objects to a beach or a bottom of a body of water, comprising:

a generally cylindrical housing, closed at a top end with a cylindrical plate, and enclosing a concavity through the opposite, bottom end, said concavity defined by a cylindrical wall, with a circumferential edge of said cylindrical wall defining the opening of said concavity, an anchorline connecting means fixedly attached to the center of the top surface of said cylindrical plate for the attachment of an anchorline from a watercraft or floating object, wherein a plurality of spikes extend downwardly from said circumferential edge, wherein said cylindrical housing has a predetermined diameter to height ratio, wherein said cylindrical wall and circumferential edge have a predetermined thickness, wherein said cylindrical housing is manufactured of material including plastics, concrete, stainless steel, galvanized metal, lead and other metals, whereby the combination of the generally cylindrical housing providing a more rounded and streamlined top surface and a diameter to height ratio providing a low profile thereby reduces the potential for injury to persons and damage to watercraft that may be in the vicinity of said anchor when installed in shallow water, as is commonly done in the environment of personal watercraft, and whereby the predetermined thickness of the cylindrical wall and the circumferential edge eases and increases the anchors engagement with the soil at bottom of the body of water during installation and when installed, a natural affinity between the soil and the surfaces of the cylindrical wall, in addition with a suction effect of the concavity, thereby increase the resistance of the anchor to be moved or dislodged, more so than would occur with only the weight of the anchor alone.

* * * * *